US008917300B2

(12) United States Patent
Arima

(10) Patent No.: US 8,917,300 B2
(45) Date of Patent: Dec. 23, 2014

(54) IMAGE ERASING APPARATUS

(71) Applicants: Kabushiki Kaisha Toshiba, Tokyo (JP); Toshiba Tec Kabushiki Kaisha, Tokyo (JP)

(72) Inventor: Yasuharu Arima, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/054,208

(22) Filed: Oct. 15, 2013

(65) Prior Publication Data

US 2014/0192125 A1 Jul. 10, 2014

(30) Foreign Application Priority Data

Jan. 10, 2013 (JP) ..... 2013-002584

(51) Int. Cl.
*B41J 29/00* (2006.01)
*B41J 2/32* (2006.01)
*B41M 7/00* (2006.01)

(52) U.S. Cl.
CPC *B41J 2/32* (2013.01); *B41M 7/0009* (2013.01)
USPC ..... 347/179

(58) Field of Classification Search
USPC ..... 347/171, 179
See application file for complete search history.

(56) References Cited

U.S. PATENT DOCUMENTS

| | | | | |
|---|---|---|---|---|
| 8,441,508 | B2 * | 5/2013 | Taki et al. | 347/179 |
| 8,538,317 | B2 * | 9/2013 | Iguchi | 399/407 |
| 2010/0118361 | A1 | 5/2010 | Iguchi | |
| 2010/0321456 | A1 * | 12/2010 | Tsuchihashi et al. | 347/179 |
| 2011/0033216 | A1 | 2/2011 | Taki et al. | |
| 2011/0074086 | A1 | 3/2011 | Iguchi et al. | |
| 2011/0222131 | A1 | 9/2011 | Yahata et al. | |
| 2013/0015623 | A1 | 1/2013 | Iguchi et al. | |
| 2013/0229477 | A1 * | 9/2013 | Taki et al. | 347/179 |

* cited by examiner

*Primary Examiner* — Huan Tran
(74) *Attorney, Agent, or Firm* — Patterson & Sheridan LLP

(57) ABSTRACT

According to an embodiment, an image erasing apparatus that erases an image formed on a recording medium is provided. The image erasing apparatus includes an erasing unit that erases an image, a reading unit that reads a size of the recording medium, a classification device that classifies the erasing-processed recording medium, and a control unit. The control unit recognizes the size of the erasing-processed recording medium based on data about the size, and controls the classification device to classify each recording medium from which the image has been erased for each different size.

10 Claims, 9 Drawing Sheets

IMAGE ERASING APPARATUS

CROSS-REFERENCE TO RELATED APPLICATION

This application is based upon and claims the benefit of priority from the prior Japanese Patent Application No. 2013-002584, filed on Jan. 10, 2013, the entire contents of which are incorporated herein by reference.

FIELD

Embodiments described herein relate generally to an image erasing apparatus that erases an image formed on a recording medium.

BACKGROUND

In order to reuse a recording medium used to print an image, for example, a sheet, an image erasing apparatus that erases the image printed on the sheet is proposed. The image erasing apparatus discharges the image erasing-processed sheet. However, when sheets of image erasing process targets with a plurality of different sizes are mixed, a user has to distribute the image erasing-processed sheets discharged from the image erasing apparatus, for each size. The distribution of the image erasing-processed sheets performed by the user is a troublesome task for the user.

DETAILED DESCRIPTION

Figure 1:
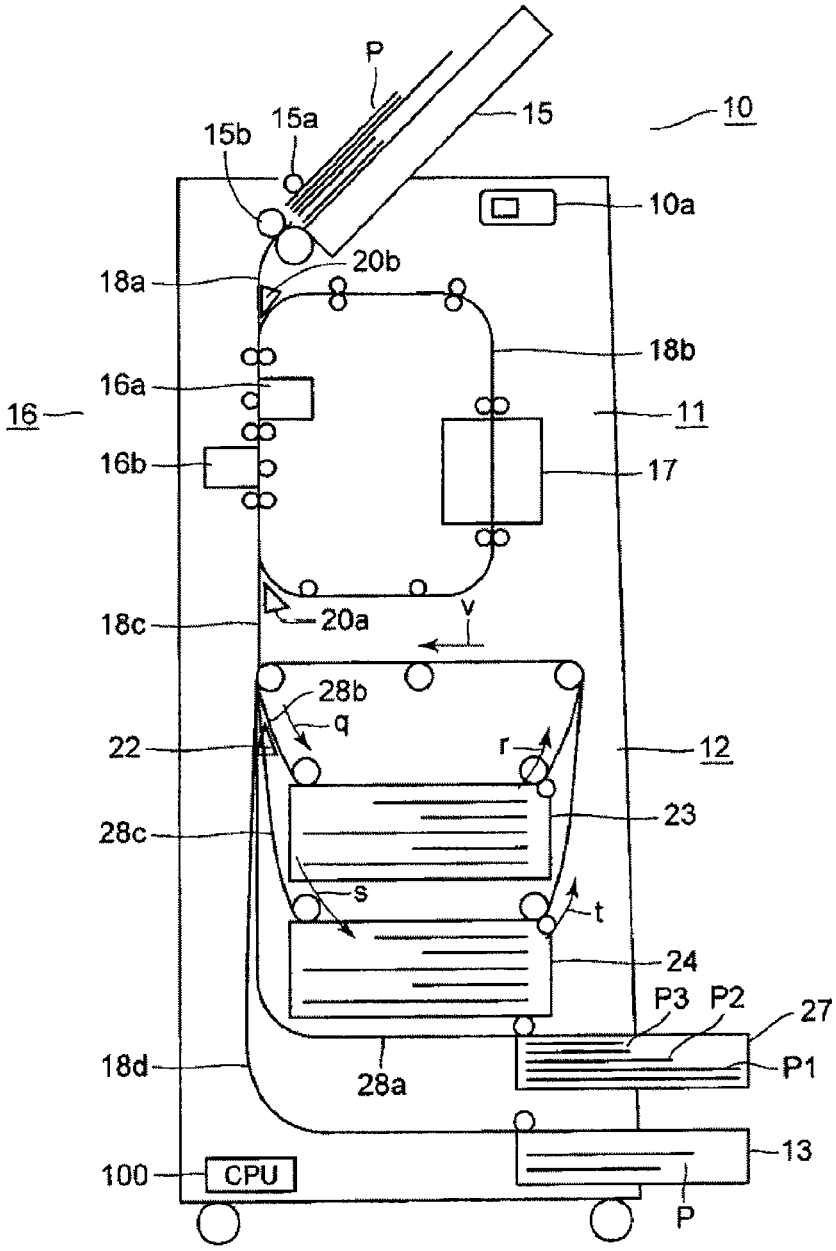
FIG. 1 is a cross-sectional view illustrating main units of an image erasing apparatus according to a first embodiment.

According to an embodiment, an image erasing apparatus that erases an image formed on a recording medium is provided. The image erasing apparatus includes an erasing unit, a reading unit, a classification device, and a control unit. The erasing unit erases an image formed on a recording medium. The reading unit reads a size of the recording medium. The classification device classifies each recording medium on which an erasing process of the image has been performed by the erasing unit, for each size. The control unit recognizes the size of the image erasing-processed recording medium based on data about the size read by the reading unit before a classification process performed by the classification device, and controls the classification device.

Hereinafter, embodiments will be further described with reference to the drawings. In the drawings, the same sign represents the same or similar portion.

Figure 2:
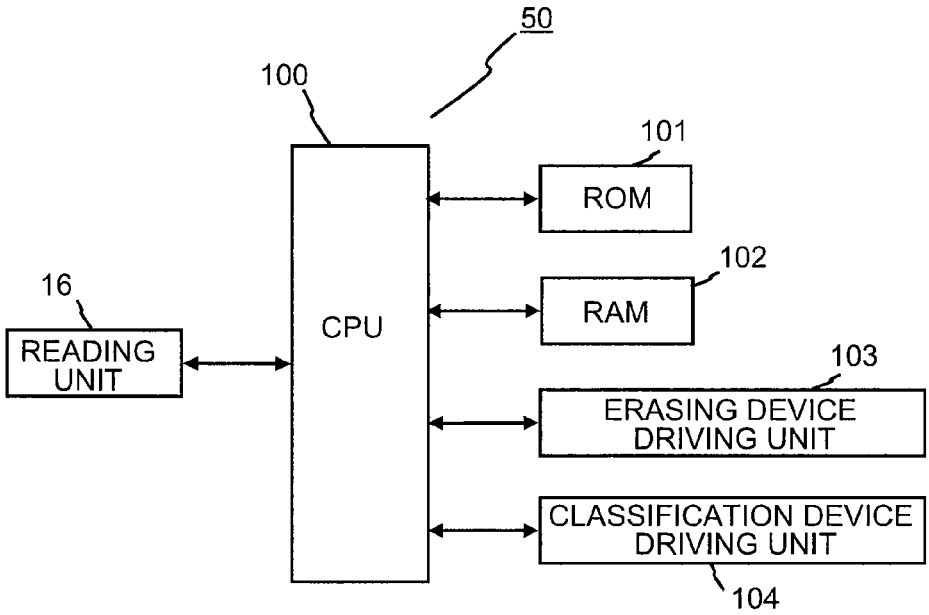
FIG. 2 is a block diagram illustrating a configuration of a control system based on classification of sheets of the image erasing apparatus according to the first embodiment.

An image erasing apparatus of a first embodiment will be described with reference to FIGS. 1 to 3. FIG. 1 is a cross-sectional view illustrating main units of the image erasing apparatus according to the first embodiment. As illustrated in FIG. 1, an image erasing apparatus 10 includes a control panel 10*a* that is provided with an operation button and a display unit, an erasing device 11 that erases an image printed on a sheet P that is a recording medium, a classification device 12 that classifies each sheet P from which the image is erased by the erasing device 11, for each size, and a reject box 13 that recovers a non-reusable sheet P. The image erasing apparatus 10 includes a central processing unit (CPU) 100 that is a control unit controlling the entirety. The image printed on an image erasing process target sheet P is formed of an erasable color material.

The erasable color material is a color material in which a color is erased or a color becomes transparent when the color material is heated at an erasing temperature. The erasable color material includes, for example, a color compound, a developer, and a decolorant. The color compound may be, for example, leuco dye. The developer may be, for example, phenols. The decolorant may be, for example, a material which is compatible with the color compound when the material is heated and has no affinity with the developer. The erasable color material is colored by interaction between the color compound and the developer, and the interaction between the color compound and the developer is cut off by heating at equal to or higher than a predetermined temperature, and thus is decolored.

The erasing device 11 includes a sheet feed unit including a sheet feed tray 15 or the like, a reading unit 16, an erasing unit 17, a first erasing transport unit 18*a*, a second erasing transport unit 18*b*, a third erasing transport unit 18*c*, and a fourth erasing transport unit 18*d*. The first erasing transport unit 18*a* includes a transport path reaching a first branch guide member 20*a* from the sheet feed tray 15 through the reading unit 16. The second erasing transport unit 18*b* includes a transport path reaching a second branch guide member 20*b* from the first branch guide member 20*a* through the erasing unit 17. The third erasing transport unit 18*c* includes a transport path reaching a classification branch guide member 22 from the first branch guide member 20*a*.

The fourth erasing transport unit 18*d* includes a transport path reaching the reject box 13 from the first branch guide member 20*a* through the classification branch guide member 22.

The sheet feed unit includes the sheet feed tray 15, a pickup roller 15*a*, and a separation roller 15*b*. The sheet feed tray 15 stacks an image erasing process target sheet P. The pickup roller 15*a* takes out the sheet P. The separation roller 15*b* separates the sheets P taken out by the pickup roller 15*a* one by one, and transports the sheet P to the reading unit 16. The reading unit 16 includes a first reading unit 16*a* and a second reading unit 16*b*. The first reading unit 16*a* and the second reading unit 16*b* are opposed with the transport path of the first erasing transport unit 18*a* interposed therebetween. The first reading unit 16*a* and the second reading unit 16*b* include, for example, a reading unit such as a charge coupled device (CCD) reading sensor or complementary metal-oxide semiconductor (CMOS) sensor. For example, the first reading unit 16*a* reads an image on a back face of the sheet P passing through the transport path of the first erasing transport unit 18*a*, and the second reading unit 16*b* reads an image on a front face of the sheet P passing through the transport path of the first erasing transport unit 18*a*. For example, the second reading unit 16*b* reads the size of the sheet P as data of the sheet P on which the image erasing process has been performed.

The erasing unit 17 erases the image on the sheet P transported by the second erasing transport unit 18*b* and passing through the erasing unit 17. For example, the erasing unit 17 erases the image formed on the sheet P by heating the image on the sheet P up to an erasing temperature.

The classification device 12 includes an upper stock box 23 and a lower stock box 24 that are stock units, a sheet discharge box 27 that is a sheet discharge unit, and a first classification transport unit 28*a*, a second classification transport unit 28*b* and a third classification transport unit 28*c*, which are transport units.

The first classification transport unit 28*a* includes a first transport path reaching the sheet discharge box 27 from the upper stock box 23 or the lower stock box 24 through the classification branch guide member 22. The second classification transport unit 28*b* includes a transport path reaching the upper stock box 23 from the lower stock box 24 through the classification branch guide member 22. The third classification transport unit 28*c* includes a transport path reaching the lower stock box 24 from the upper stock box 23 through the classification branch guide member 22. The transport paths of the second classification transport unit 28*b* and the third classification transport unit 28*c* constitute a second transport path.

The upper stock box 23 and the lower stock box 24 stack the sheets P, for example, in order of erasing the image by the erasing device 11 to temporarily accommodate them. Accordingly, when the image erasing process target sheets P are sheets with a plurality of different sizes, the upper stock box 23 and the lower stock box 24 stack the sheets P in a state where the sheets P with the plurality of sizes are mixed. The upper stock box 23 accommodates, once, all the sheets P transported from an arrow q direction after the image erasing process is performed. The sheet P placed on the upper stock box 23 is taken out in an arrow r direction, and is transported in a sheet discharge direction of an arrow v direction.

The classification device 12 accommodates the sheet P in the lower stock box 24 from the arrow s direction, excluding the sheet P accommodated in the sheet discharge box 27, among the sheets P transported in the sheet discharge direction v from the upper stock box 23. The classification device 12 takes out the sheet P accommodated in the lower stock box 24 in an arrow t direction, and transports the sheet P in the sheet discharge direction of the arrow v direction. The classification device 12 accommodates the sheet P in the upper stock box 23 from the arrow q direction, excluding the sheet P accommodated in the sheet discharge box 27, among the sheets P transported in the sheet discharge direction v from the lower stock box 24.

The classification device 12 alternately accommodates the sheets P in the upper stock box 23 and the lower stock box 24 until all the sheets P are completely classified for each size. The sheet discharge box 27 accommodates the sheets P with the same sizes, which are classified from the sheets P in the upper stock box 23 or the lower stock box 24, to be overlapped with each other in descending order of size.

A control system based on classification of sheets of the image erasing apparatus 10 will be described with reference to FIG. 2. FIG. 2 is a block diagram illustrating a configuration of the control system based on classification of sheets of the image erasing apparatus according to the first embodiment. As illustrated in FIG. 2, a control system 50 includes the CPU 100 that is a control unit, a read only memory (ROM) 101 and a random access memory (RAM) 102 that are storage units, an erasing device driving unit 103, a classification device driving unit 104, and a reading unit 16.

The CPU 100 executes a program stored in the ROM 101 or the RAM 102 to realize image erasing and classification of sheets from which an image is erased for each size. The ROM 101 stores a control program and control data for a basic operation of the image erasing apparatus 10. The RAM 102 stores various kinds of information necessary for the CPU 100 performing various processes. The RAM 102 stores, for example, identification information ID for identifying the sheet P read by the second reading unit 16*b*. The second reading unit 16*b* and the RAM 102 constitute an identification unit.

The identification information ID for identifying the sheet P includes information about a transport order to the second reading unit 16*b* and information about the size of the sheet. In the sheets P transported from the upper stock box 23 or the lower stock box 24, the remaining sheets P excluding all the sheets P with the same predetermined size discharged to the sheet discharge box 27 return to the upper stock box 23 or the lower stock box 24. Even when the sheets P with the same predetermined size are discharged to the sheet discharge box 27 on the way to the stock box, the identification information ID identifies the sheets P returning to the upper stock box 23 or the lower stock box 24. For example, when the sheets P with the same size are discharged to the sheet discharge box 27, the identification information ID of the discharged sheet P is deleted to update the identification information ID stored in the RAM 102.

The image erasing apparatus is not limited to the configuration described above. For example, the erasing device may only read the image data of the sheet by the reading unit without performing the erasing of the image. In the erasing method of the image, the image may be erased by irradiating light not heat or by a chemical reaction.

In the image erasing apparatus 10 described above, the user stacks the image erasing process target sheet Pin the sheet feed tray 15. The image erasing process target sheet P includes, for example, a fixed-size sheet and an unfixed-size sheet. In addition, the fixed-size sheet P includes, for example, sheets with an A3 size, a B4 size, and an A4 size prescribed in JIS standard.

The user who wants to erase the image on the sheet P operates the control panel 10*a* to instruct start of the erasing operation after the sheet P is stacked in the sheet feed tray 15. The CPU 100 drives the driving unit 103 in response to the start instruction of the erasing operation received by the control panel 10*a*, to control the operations of the pickup roller 15*a*, the separation roller 15*b*, and the first erasing transport unit 18*a*. The pickup roller 15*a*, the separation roller 15*b*, and the first erasing transport unit 18*a* transport the sheet P to the reading unit 16. In addition, the CPU 100 operates the reading unit 16. The reading unit 16 reads the image on the sheet P before the image erasing process. The CPU 100 determines whether the sheet P is reusable based on the reading data read by the reading unit 16. When the sheet P is reusable, the CPU 100 controls the operation of the second erasing transport unit 18*b*. The second erasing transport unit 18*b* transports the sheet P to the erasing unit 17. When the sheet P is not reusable, the CPU 100 controls the operation of the fourth erasing transport unit 18*d*. The fourth erasing transport unit 18*d* discharges the sheet P to the reject box 13.

When the sheet P is reusable, the CPU 100 further controls the operation of the erasing unit 17. The erasing unit 17 heats the image on the sheet P at the erasing temperature to erase the image. The first erasing transport unit 18*a* and the second erasing transport unit 18*b* transport the image erasing-processed sheet P to the reading unit 16 again. The reading unit 16 reads the image on the image erasing-processed sheet P again. The CPU 100 determines whether the image erasing-processed sheet P is reusable based on the reading data read by the reading unit 16 after the image erasing. When the image erasing-processed sheet P is not reusable, the fourth erasing transport unit 18*d* discharges the sheet P to the reject box 13.

When the image erasing-processed sheet P is reusable, the second reading unit 16*b* reads the size of the sheet P. When the sheet P is the fixed-size sheet, the CPU 100 recognizes the size of the sheet P as a specific size, for example, A3, B4, or the like based on the data read by the second reading unit 16*b*. In addition, when the sheet P is the unfixed-size sheet, the CPU 100 recognizes the size of the sheet P, for example, merely as the unfixed size, based on the data read by the second reading unit 16*b*. In addition, the CPU 100 sequentially stores the identification information ID for identifying the sheet P in the RAM 102 based on the data read by the second reading unit 16*b*. For example, when the first reusable sheet P transported to the reading unit 16 is the A3-size sheet, the second reusable sheet P is the A4-size sheet, and the m-th reusable sheet P is the unfixed-size sheet, the RAM 102 stores the information of "first=A3 size", "second=A4 size", and "m-th=unfixed size" as the identification information ID. The CPU 100 controls the classification device 12 to classify the reusable sheet P for each size according to the identification information ID. An operation of classifying, by the classification device 12, the reusable sheets P from which the image is erased by the erasing device 11, for each size such as A3 size, B4 size, A4 size, and unfixed size will be described with reference to flowcharts illustrated in FIGS. 3A to 3*c*.

Figure 3A:
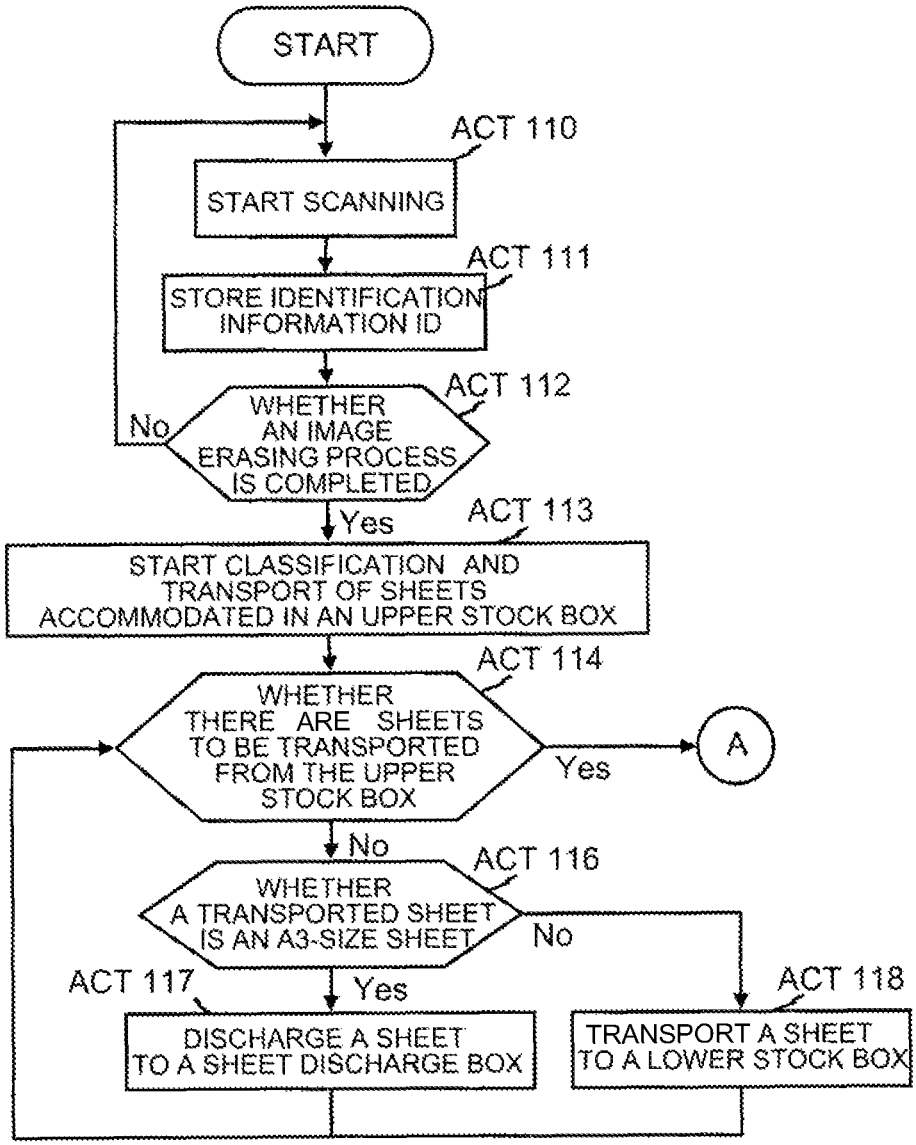
FIGS. 3A to 3C are flowcharts illustrating a classification operation for each size of sheets performed by a classification device of the image erasing apparatus according to the first embodiment.
Figure 3B:
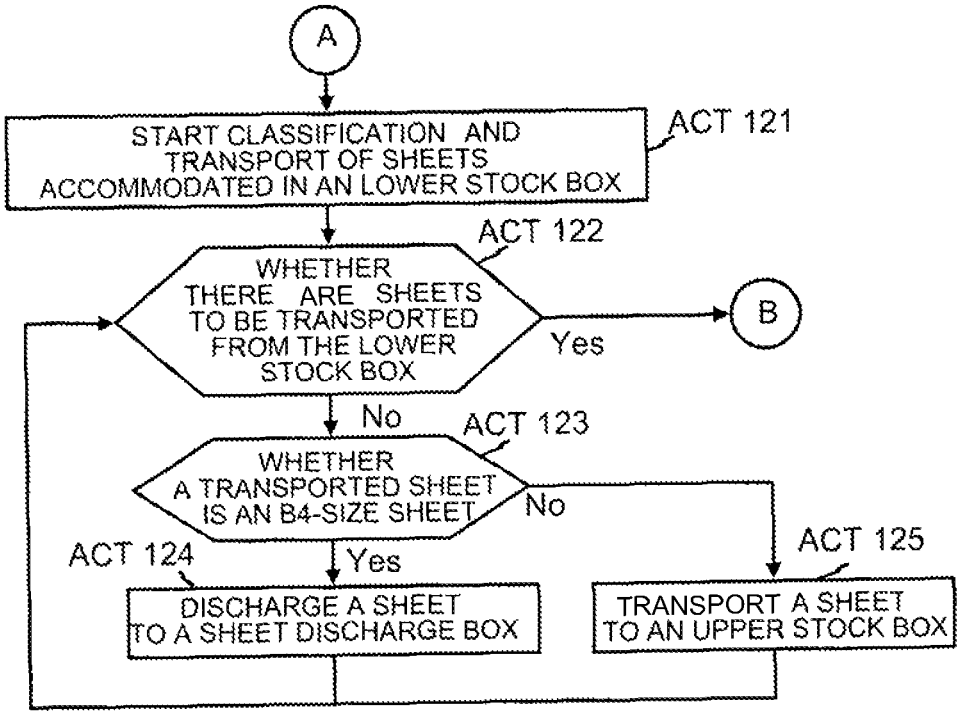
Figure 3C:
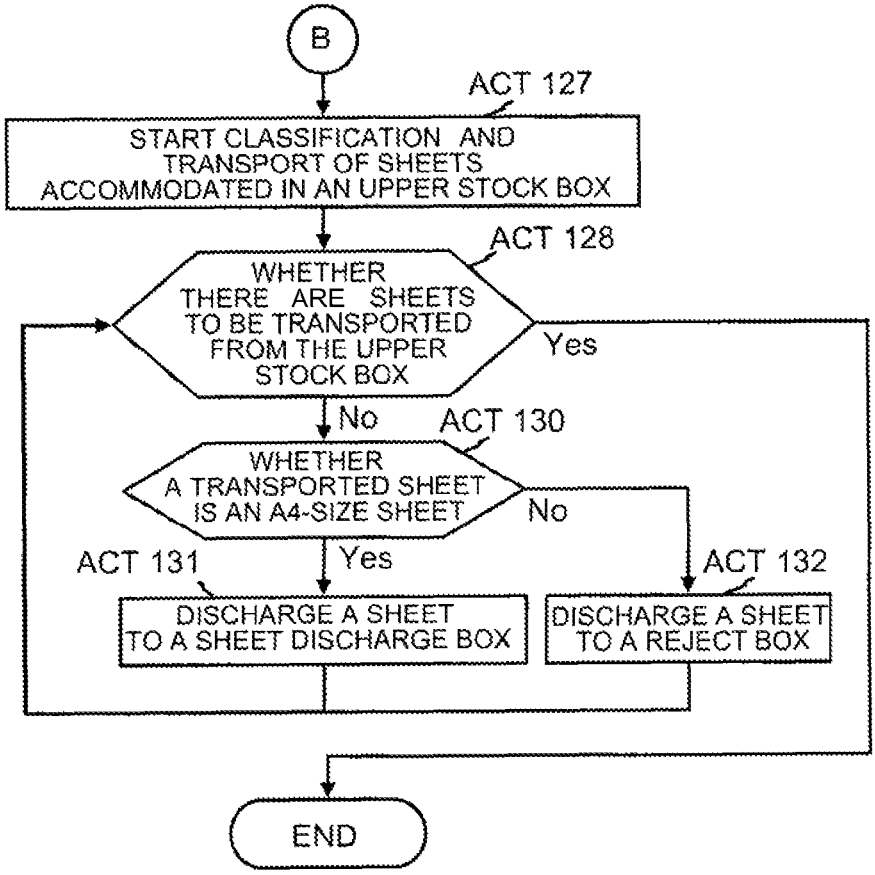

FIGS. 3A to 3*c* are flowchart illustrating a classification operation for each size of the sheet by the classification device of the image erasing apparatus according to the first embodiment. As illustrated in FIGS. 3A to 3C, in Act 110, after the erasing unit 17 erases the image on the sheet P, the reading unit 16 scans the sheet P again, and reads the image on the sheet P. It is determined whether the image erasing-processed sheet P is reusable based on the data read by the reading unit 16. When the sheet P is not reusable, as described above, the sheet P is discharged to the reject box 13. When the sheet P is reusable, the operation of the image erasing apparatus 10 proceeds to Act 111. In Act 111, the CPU 100 stores the identification information ID for identifying the sheet P for each sheet P in the RAM 102 based on the data read by the second reading unit 16*b* as described above. The CPU 100 controls the operation of the third erasing transport unit 18*c*. The third erasing transport unit 18*c* transports the reusable sheet P to the upper stock box 23 in order of erasing the image. The upper stock box 23 accommodates the reusable sheet P in order of erasing the image. Accordingly, the sheets P with a plurality of sizes are accommodated together in the upper stock box 23. The CPU 100 identifies the transport order and size of the sheets P accommodated together in the upper stock box 23 by the identification information ID stored in the RAM 102.

In Act 112, the CPU 100 waits for completion of the image erasing process by completing the rescanning of all the sheets P from which the image is erased. When the CPU 100 determines that the image erasing process is completed, the operation of the image erasing apparatus 10 proceeds to Act 113. In Act 113, the CPU 100 controls the classification device 12 to classify the sheets P in order of a large sheet size except for the unfixed size with reference to the identification information ID stored in the RAM 102. Accordingly, first, the classification device 12 starts classification from the sheets P accommodated in the upper stock box 23 to an A3-size sheet P1.

In Act 113, the third classification transport unit 28*c* of the classification device 12 sequentially classifies the sheets P accommodated in the upper stock box 23, and transports the sheets P in the direction of the branch guide member 22. In Act 114, the CPU 100 determines whether there is the sheet P to be transported from the upper stock box 23. When there is the sheet P to be transported from the upper stock box 23 (No in Act 114), the operation of the image erasing apparatus 10 proceeds to Act 116. In Act 116, the CPU 100 recognizes whether the size of the sheet P is the A3 size by the identification information ID. When the CPU 100 recognizes that the sheet P transported from the upper stock box 23 is the A3-size sheet (Yes in Act 116), the operation of the image erasing apparatus 10 proceeds to Act 117. In Act 117, the CPU 100 controls the operation of the classification device 12 to direct the classification branch guide member 22 to the direction of the first classification transport unit 28*a*. The first classification transport unit 28*a* discharges the sheet P1 to the sheet discharge box 27. Accordingly, the sheet discharge box 27 accommodates the A3-size sheet P1.

In Act 116, when the CPU 100 recognizes that the sheet P transported from the upper stock box 23 is not the A3-size sheet (No in Act 116), the operation of the image erasing apparatus 10 proceeds to Act 118. In Act 118, the CPU 100 controls the operation of the classification device 12 to direct the classification branch guide member 22 to the direction of the third classification transport unit 28*c*. The third classification transport unit 28*c* transports the sheet P to the lower stock box 24. Accordingly, the lower stock box 24 accommodates the sheets P1 other than the A3 size. When the operations of Act 117 and Act 118 are completed, the operation of the image erasing apparatus 10 returns to Act 114. In Act 114, when there is no sheet P to be transported from the upper stock box 23, in other words, when the transport of all the sheets P in the upper stock box 23 is completed (Yes in Act 114), the operation of the image erasing apparatus 10 proceeds to Act 121. In Act 121, since the transport of all the sheets P in the upper stock box 23 is completed, the sheet discharge box 27 completes the accommodation of all the A3-size sheets P1 accommodated in the upper stock box 23. The classification device 12 allows the sheet discharge box 27 to accommodate all the A3-size sheets P1 thereby completing the classification of the A3-size sheets P1. At the time point when the classification of the A3-size sheets P1 is completed, the lower stock box 24 completes the accommodation of all the sheets P with the sizes other than the A3 size in a state where the sheets P with the plurality of sizes other than the A3 size are mixed. The CPU 100 deletes the identification information ID of the A3-size sheet P from the RAM 102 to update the identification information ID stored in the RAM 102. The CPU 100 identifies the transport order and size of the sheets P other than the A3 size accommodated in the lower stock box 24 by the identification information ID stored in the updated RAM 102.

In Act 121, the CPU 100 controls the classification device 12 to start classification of the second largest B4-size sheet P2 to the A3-size sheet, excluding the unfixed size. In Act 121, the second classification transport unit 28*b* of the classification device 12 sequentially transports the sheets P accommodated in the lower stock box 24 in the direction of the classification branch guide member 22. In Act 122, the CPU 100 determines whether there is the sheet P to be transported from the lower stock box 24. When there is the sheet P to be transported from the lower stock box 24 (No in Act 122), the operation of the image erasing apparatus 10 proceeds to Act 123. In Act 123, the CPU 100 recognizes whether the size of the sheet P is the B4 size by the identification information ID. When the CPU 100 recognizes that the sheet P transported from the lower stock box 24 is the B4-size sheet (Yes in Act 123), the operation of the image erasing apparatus 10 proceeds to Act 124. In Act 124, the CPU 100 controls the operation of the classification device 12 to direct the classification branch guide member 22 to the direction of the first classification transport unit 28*a*. In addition, the first classification transport unit 28*a* discharges the sheet P2 to the sheet discharge box 27. Accordingly, the sheet discharge box 27 accommodates the B4-size sheet P2.

In Act 123, when the CPU 100 recognizes that the sheet P transported from the lower stock box 24 is not the B4-size sheet P2 (No in Act 123), the operation of the image erasing apparatus 10 proceeds to Act 125. In Act 125, the CPU 100 controls the operation of the classification device 12 to direct the classification branch guide member 22 to the direction of the second classification transport unit 28*b*. The second classification transport unit 28*b* transports the sheet P to the upper stock box 23. Accordingly, the upper stock box 23 accommodates the sheets P other than the B4 size. When the operations of Act 124 and Act 125 are completed, the operation of the image erasing apparatus 10 returns to Act 122. In Act 122, when there is no sheet P to be transported from the lower stock box 24, in other words, when the transport of all the sheets P in the lower stock box 24 is completed (Yes in Act 122), the operation of the image erasing apparatus 10 proceeds to Act 127.

In Act 127, since the transport of all the sheets P in the lower stock box 24 is completed, the sheet discharge box 27 completes the accommodation of all the B4-size sheets P2 accommodated in the lower stock box 24 in a state of being stacked on the A3-size sheet P1. The classification device 12 allows the sheet discharge box 27 to accommodate all the B4-size sheets P2, thereby completing the classification of the B4-size sheets P2. At the time point when the classification of the B4-size sheets P2 is completed, the upper stock box 23 completes the accommodation of the sheets P with the sizes other than the B4 size and the A3 size in a state where the sheets P with the sizes other than the B4 size and the A3 size are mixed. The CPU 100 deletes the identification information ID of the B4-size sheet P2 from the RAM 102 to update the identification information ID stored in the RAM 102. The CPU 100 identifies the transport order and size of the sheets P other than the B4 size and the A3 size accommodated in the upper stock box 23 by the identification information ID stored in the updated RAM 102. As described above, the reusable sheets P which are stacked in the sheet feed tray 15 and from which the image is erased are the sheets with the A3 size, the B4 size, the A4 size, and the unfixed size. Accordingly, at the time point when the classification device 12 completes the classification of the B4-size sheets P2, the sheets P with the A4 size and the unfixed size are accommodated in the upper stock box 23.

In Act 127, the CPU 100 controls the classification device 12 to start classification of the second largest A4-size sheet P3 to the B4-size sheet, excluding the unfixed size. In Act 127, the third classification transport unit 28*c* of the classification device 12 sequentially transports the sheets P accommodated in the upper stock box 23 in the direction of the classification branch guide member 22. In Act 128, the CPU 100 determines whether there is the sheet P to be transported from the upper stock box 23. When there is the sheet P to be transported from the upper stock box 23 (No in Act 128), the operation of the image erasing apparatus 10 proceeds to Act 130. In Act 130, the CPU 100 recognizes whether the size of the sheet P is the A4 size by the identification information ID. When the CPU 100 recognizes that the sheet P transported from the upper stock box 23 is the A4-size sheet (Yes in Act 130), the operation of the image erasing apparatus 10 proceeds to Act 131. In Act 131, the CPU 100 controls the operation of the classification device 12 to direct the classification branch guide member 22 to the direction of the first classification transport unit 28*a*. In addition, the first classification transport unit 28*a* discharges the sheet P1 to the sheet discharge box 27. Accordingly, the sheet discharge box 27 accommodates the A4-size sheet P3.

In Act 130, when the CPU 100 recognizes that the sheet P transported from the upper stock box 23 is not the A4-size sheet (No in Act 130), the operation of the image erasing apparatus 10 proceeds to Act 132. In Act 132, the CPU 100 controls the operation of the classification device 12 to direct the classification branch guide member 22 to the direction of the fourth erasing transport unit 18*d*. The fourth erasing transport unit 18*d* discharges the sheet P to the reject box 13. Accordingly, the reject box 13 accommodates the unfixed-size sheet P4. When the operations of Act 131 and Act 132 are completed, the operation of the image erasing apparatus 10 returns to Act 128. In Act 128, when there is no sheet P to be transported from the upper stock box 23, in other words, when the transport of all the sheets P in the upper stock box 23 is completed (Yes in Act 128), the classification device 12 completes the classification for each size of the reusable sheets from which the image is erased.

When the classification device 12 completes the classification for each size of the reusable sheets from which the image is erased, the sheet discharge box 27 completes the accommodation of all the A4-size sheets P3 accommodated in the upper stock box 23 in a state where all the A4-size sheets P3 accommodated in the upper stock box 23 are stacked on the B4-size sheet P2. Accordingly, the classification device 12 allows the sheet discharge box 27 to accommodate all the A4-size sheets P3, thereby completing the classification of the A4-size sheets P1. In addition, the reject box 13 completes the accommodation of all the unfixed-size sheets P accommodated in the upper stock box 23. Accordingly, the classification device 12 allows the reject box 13 to accommodate all the unfixed-size sheets P, thereby completing the classification of the unfixed-size sheets P. In other words, the classification device 12 allows the sheet discharge box 27 to accommodate all the reusable sheets P which are stacked in the sheet feed tray 15 and from which the image is erased, or the reject box 13 to discharge them, thereby completing the classification.

When the classification by the classification device 12 is completed, the operation of the image erasing apparatus 10 is completed. In the sheet discharge box 27, the A3-size sheet P1 with the large size, the B4-size sheet P2 with the second largest size, and the A4-size sheet P3 with the small size are accommodated in a stack state for each size, in order from the bottom. The user may take out and reuse the sheet P from the sheet discharge box 27.

According to the first embodiment, the operation that the user distributes the sheets P to be reused after the image erasing for each size is unnecessary. The user can take out the sheets P stacked in the sheet discharge box 27 in order from the small size for each size. The sizes of the sheets classified by the classification device 12 are not limited thereto, and may be an A5 size or a postcard size.

According to the first embodiment, the sheets P from which the image is erased by the erasing device 11 of the image erasing apparatus 10 are classified for each size by the classification device 12, and the sheets P with the plurality of sizes are stacked for the same size in the sheet discharge box 27. When the image is erased and the sheet P is reused, it is possible to reduce an effort that the user distributes the sheets P with the necessary size from the sheets P from which the image is erased. The user easily uses the reused sheets P. According to the first embodiment, the reusable sheets P are classified in order from the large size to the small size, and are stacked in the sheet discharge box 27. The user can easily take out the sheets P from the sheet discharge box 27 in order of the small size.

An image erasing apparatus of a second embodiment will be described with reference to FIGS. 4 and 5. In the image erasing apparatus of the second embodiment, a transport destination of a sheet after sheet classification is different from the image erasing apparatus of the first embodiment. In the image erasing apparatus of the second embodiment, the same sign is attached to the same configuration as the configuration of the image erasing apparatus of the first embodiment described above, and the detailed description thereof is omitted.

Figure 4:
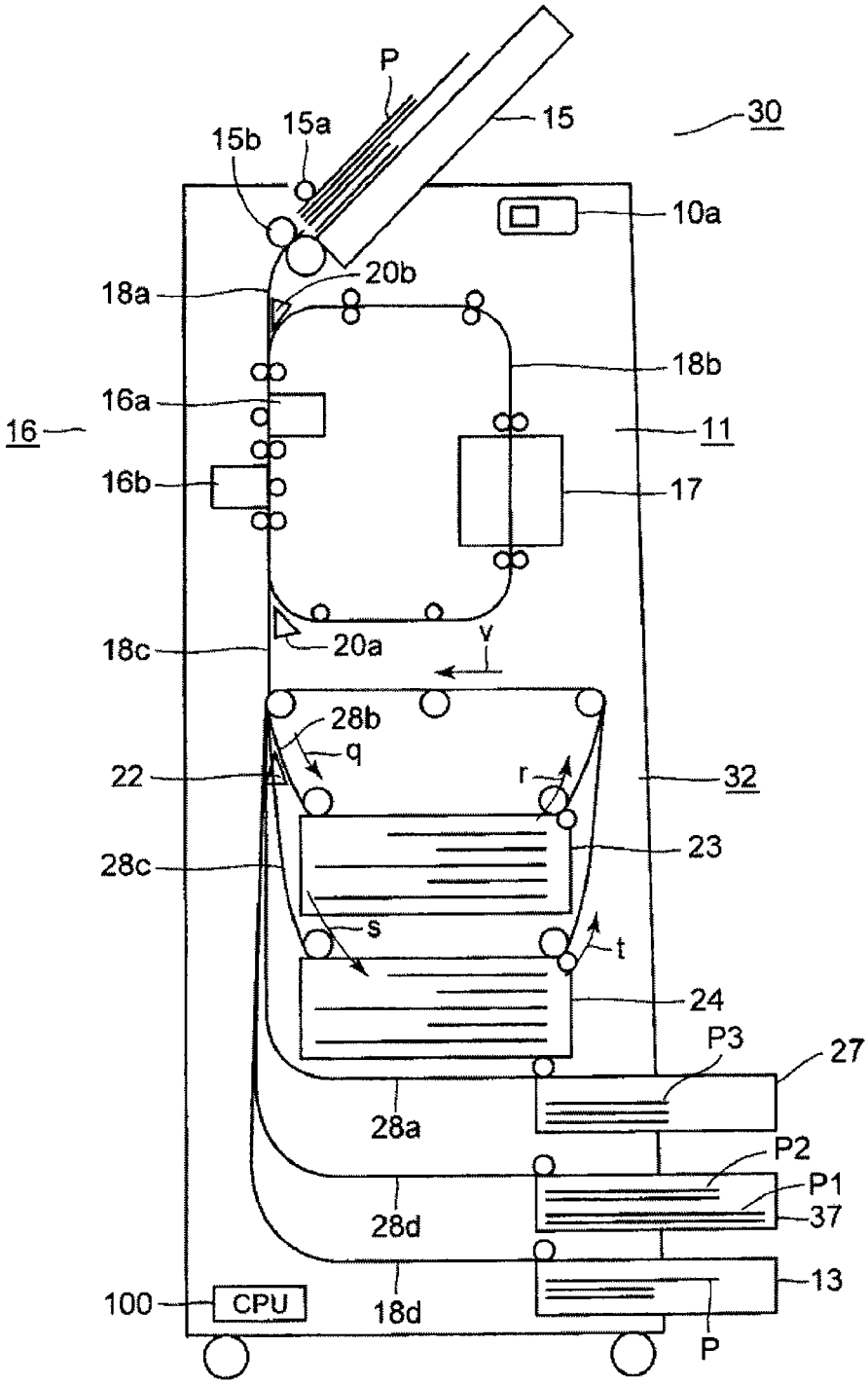
FIG. 4 is a cross-sectional view illustrating main units of an image erasing apparatus according to a second embodiment.

FIG. 4 is a cross-sectional view illustrating main units of the image erasing apparatus according to the second embodiment. As illustrated in FIG. 4, a classification device 32 of an image erasing apparatus 30 according to the second embodiment includes an auxiliary sheet discharge box 37 as a secondary sheet discharge box in addition to the sheet discharge box 27. The classification device 32 includes a fourth classification transport unit 28*d* as a transport unit in addition to the first to third classification transport units 28*a* to 28*c*. The fourth classification transport unit 28*d* constitutes a first transport path, and has a transport path reaching the auxiliary sheet discharge box 37 from the upper stock box 23 or the lower stock box 24 through the classification branch guide member 22.

The sheet discharge box 27 accommodates, for example, a main-size sheet P classified from the sheets P in the upper stock box 23 or the lower stock box 24. The main-size sheet P is, for example, a sheet P with the highest-frequency size reused by the user. The main-size sheet P is, for example, an A4-size sheet P3. The auxiliary sheet discharge box 37 accommodates the sheets P with sizes other than the main size classified from the sheets P in the upper stock box 23 or the lower stock box 24 to be stacked in order of the large size from the bottom.

In the image erasing apparatus 30, the classification device 32 allows the sheet discharge box 27 to accommodate only the main-size sheet P from the first classification transport unit 28*a* according to the identification information ID of each sheet P. The classification device 32 allows the auxiliary sheet discharge box 37 to accommodate the sheets P except for the main-size sheet P to be stacked in order of the large size from the fourth classification transport unit 28*d* with reference to the identification information ID of each sheet P. The CPU 100 controls the classification device 32 to classify the reusable sheets P for each size according to identification information ID. The operation that the classification device 32 classifies the reusable sheets P from which the image is erased by the erasing device 11 for each size such as A3 size, B4 size, A4 size, and an unfixed size will be described with reference to flowcharts illustrated in FIGS. 5A to 5C.

Figure 5A:
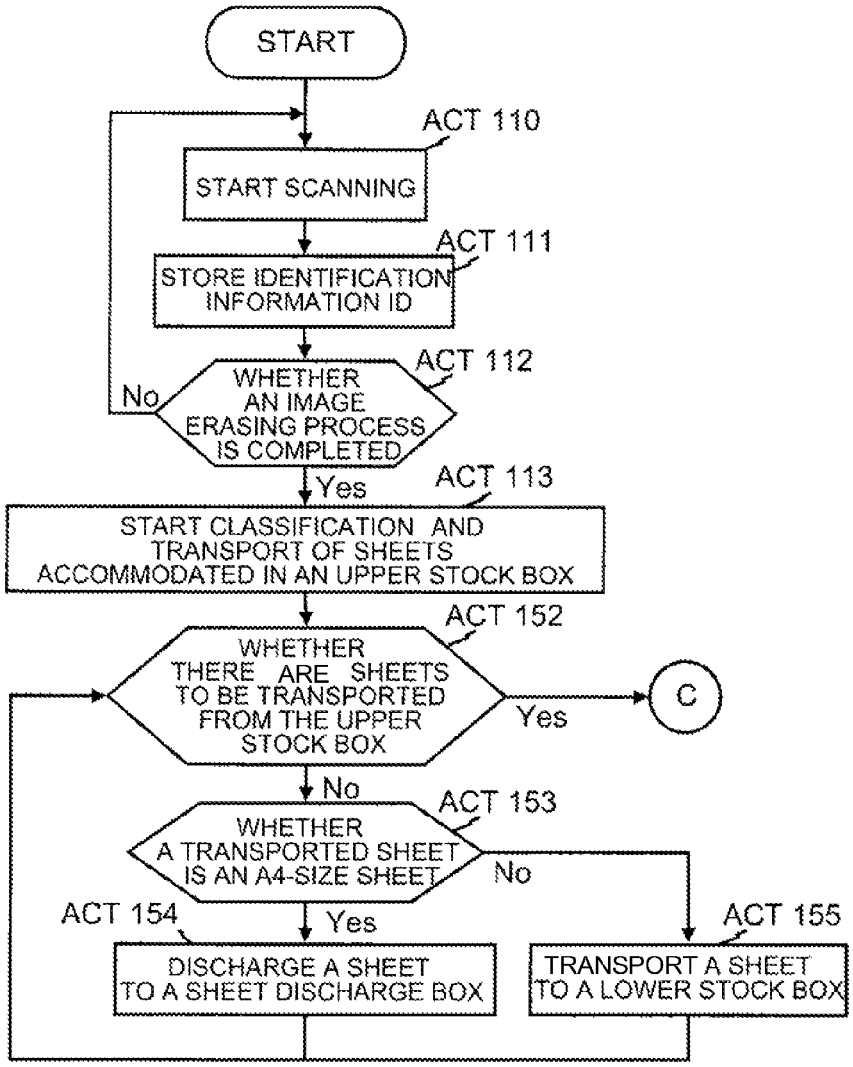
FIGS. 5A to 5*c* are flowcharts illustrating a classification operation for each size of sheets performed by a classification device of the image erasing apparatus according to the second embodiment.
Figure 5B:
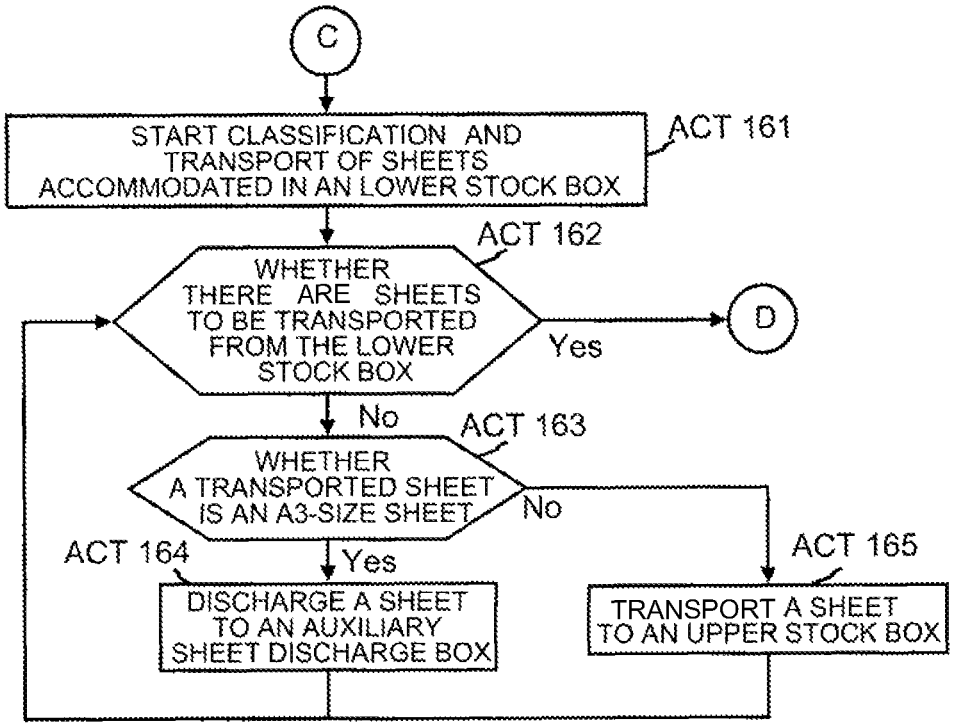
Figure 5C:
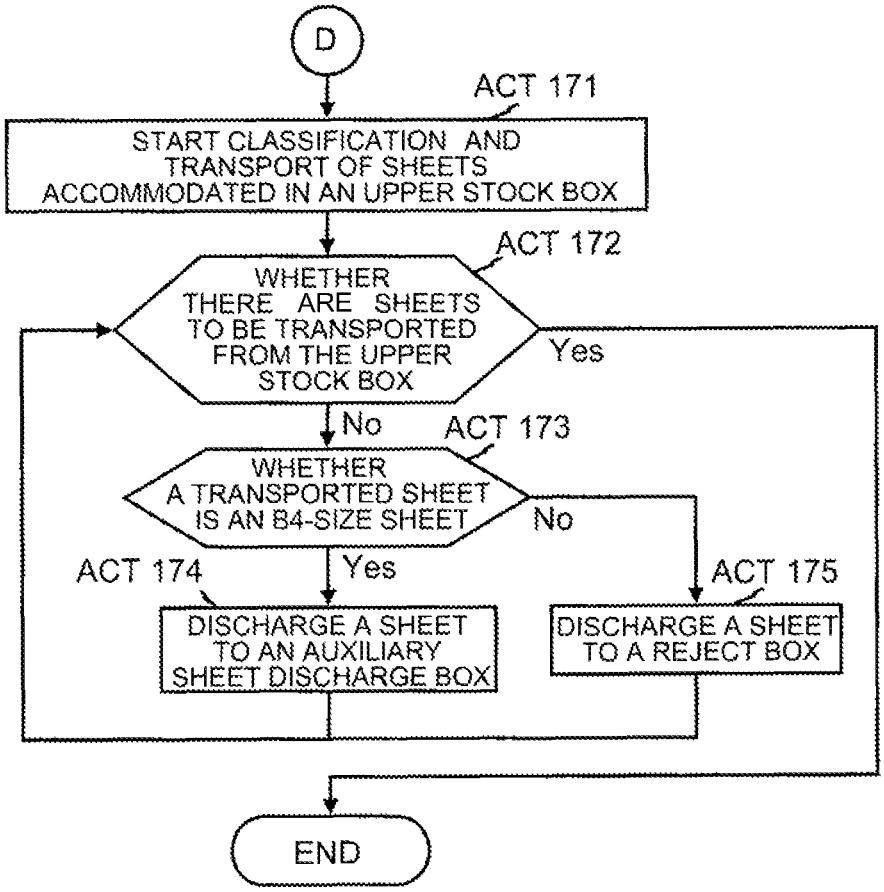

FIGS. 5A to 5C are flowcharts illustrating a classification operation for each size of the sheets by the classification device of the image erasing apparatus according to the second embodiment. As illustrated in FIGS. 5A to 5*c*, the CPU 100 controls the classification device 32 similarly to the first embodiment in Acts 110 to 113. In Act 113, the third classification transport unit 28*c* of the classification device 32 sequentially transports the sheets P on the upper stock box 23 in the direction of the classification brand guide member 22. In Act 152, the CPU 100 determines whether there is the sheet P to be transported from the upper stock box 23. When there is the sheet P to be transported from the upper stock box 23 (No in Act 152), the operation of the image erasing apparatus 30 proceeds to Act 153. In Act 153, the CPU 100 recognizes whether the size of the sheet P is A4 size of the main size by the identification information. When the CPU 100 recognizes that the sheet P transported from the upper stock box 23 is the A4-size sheet (Yes in Act 153), the operation of the image erasing apparatus 30 proceeds to Act 154. In Act 154, the CPU 100 controls the operation of the classification device 12 to direct the classification branch guide member 22 to the direction of the first classification transport unit 28*a*. The first classification transport unit 28*a* discharges the A4-size sheet P3 to the sheet discharge box 27. Accordingly, the sheet discharge box 27 accommodates the A4-size sheet P3.

In Act 153, when the CPU 100 recognizes that the sheet P transported from the upper stock box 23 is not the A4-size sheet P3 (No in Act 153), the operation of the image erasing apparatus 30 proceeds to Act 155. In Act 155, the CPU 100 controls the operation of the classification device 32 to direct the classification brand guide member 22 to the direction of the third classification transport unit 28*c*. The third classification transport unit 28*c* transports the sheet P to the lower stock box 24. Accordingly, the lower stock box 24 accommodates the sheets P other than A4 size. When the operations of Acts 154 and 155 are completed, the operation of the image erasing apparatus 30 returns to Act 152. In Act 152, when there is no sheet P to be transported from the upper stock box 23, in other words, when the transport of all the sheets P in the upper stock box 23 is completed (Yes in Act 152), the operation of the image erasing apparatus 30 proceeds to Act 161. In Act 161, since the transport of all the sheets P in the upper stock box 23 is completed, the sheet discharge box 27 completes the accommodation of all the A4-size sheets P3 that have been accommodated in the upper stock box 23. The classification device 32 allows the sheet discharge box 27 to accommodate all the A4-size sheets P3, thereby completing the classification of the A4-size sheets P3. At the time point when the classification of the A4-size sheets P3 is completed, the lower stock box 24 completes the accommodation of all the sheets P other than A4 size in a state where the sheets P with the plurality of sizes other than A4 size are mixed. In Act 161, the CPU 100 deletes the identification information ID of the A4-size sheet P3 from the RAM 102 to update the identification information ID stored in the RAM 102. The CPU 100 identifies the transport order and size of the sheets P other than A4 size accommodated in the lower stock box 24 by the identification information ID stored in the updated RAM 102.

In Act 161, the CPU 100 controls the classification device 32 to classify the sheets P in order of a large sheet size except for an unfixed size according to the identification information ID stored in the RAM 102. Accordingly, the classification device 32 starts classification of the A3-size sheets P1 from the sheets P accommodated in the lower stock box 24. In Act 161, the second classification transport unit 28*b* of the classification device 32 sequentially transports the sheets P accommodated in the lower stock box 24 in the direction of the classification branch guide member 22. In Act 162, the CPU 100 determines whether there is the sheet P to be transported from the lower stock box 24. When there is the sheet P to be transported from the lower stock box 24 (No in Act 162), the operation of the image erasing apparatus 30 proceeds to Act 163. In Act 163, the CPU 100 recognizes whether the size of the sheet P is A3 size by the identification information ID. When the CPU 100 recognizes that the sheet P from the lower stock box 24 is the A3-size sheet P1 (Yes in Act 163), the operation of the image erasing apparatus 30 proceeds to Act 164. In Act 164, the CPU 100 controls the classification device 32 to direct the classification branch guide member 22 to the direction of the fourth classification transport unit 28*d*.

The fourth classification transport unit 28*d* discharges the sheet P1 to the auxiliary sheet discharge box 37. Accordingly, the auxiliary sheet discharge box 37 accommodates the A3-size sheet P1.

In Act 163, when the CPU 100 recognizes that the sheet P from the lower stock box 24 is not the A3-size sheet P1 (No in Act 163), the operation of the image erasing apparatus 30 proceeds to Act 165. In Act 165, the CPU 100 controls the classification device 32 to direct the classification branch guide member 22 to the direction of the second classification transport unit 28*b*. The second classification transport unit 28*b* transports the sheet P to the upper stock box 23. Accordingly, the upper stock box 23 accommodates the sheets P other than A3 size. When the operations of Acts 164 and 165 are completed, the operation of the image erasing apparatus 30 returns to Act 162. In Act 162, when there is no sheet P to be transported from the lower stock box 24, in other words, when the transport of all the sheets P in the lower stock box 24 is completed (Yes in Act 162), the operation of the image erasing apparatus 30 proceeds to Act 171.

In Act 171, since the transport of all the sheets P in the lower stock box 24 is completed, the auxiliary sheet discharge box 37 completes the accommodation of all the A3-size sheets P1 that have been accommodated in the lower stock box 24. The classification device 32 allows the auxiliary sheet discharge box 37 to accommodate all the A3-size sheets P1, completing the classification of the A3-size sheets P1. At the time point when the classification of the A3-size sheets P1 is completed, the upper stock box 23 completes the accommodation of the sheets P with the sizes other than A4 size and A3 size in a state where the sheets P with the sizes other than A4 size and A3 size are mixed. The CPU 100 deletes the identification information ID of the A3-size sheet P1 from the RAM 102 to update the identification information ID stored in the RAM 102. The CPU 100 recognizes the transport order and size of the sheets P accommodated in the upper stock box 23 by the identification information ID stored in the updated RAM 102. As described above, the reusable sheets P which are stacked in the sheet feed tray 15 and from which the image is erased are the sheets with A3 size, B4 size, A4 size, and an unfixed size. Accordingly, at the time point when the classification device 32 completes the classification of the A3-size sheets P1, the sheets P with B4 size and an unfixed size are accommodated in the upper stock box 23.

In Act 171, the CPU 100 controls the classification device 32 to start classification of the second largest B4-size sheet P2 to the A3-size sheet, excluding the unfixed size. In Act 171, the third classification transport unit 28*c* of the classification device 32 sequentially transports the sheets P accommodated in the upper stock box 23 in the direction of the classification branch guide member 22. In Act 172, the CPU 100 determines whether there is the sheet P to be transported from the upper stock box 23. When there is the sheet P to be transported from the upper stock box 23 (No in Act 172), the operation of the image erasing apparatus 30 proceeds to Act 173. In Act 173, the CPU 100 recognizes whether the size of the sheet P is B4 size by the identification information ID. When the CPU 100 recognizes that the sheet P transported from the upper stock box 23 is the B4-size sheet P2 (Yes in Act 173), the operation of the image erasing apparatus 30 proceeds to Act 174. In Act 174, the CPU 100 controls the operation of the classification device 32 to direct the classification branch guide member 22 to the direction of the fourth classification transport unit 28*d*. In addition, the fourth classification transport unit 28*d* discharges the sheet P2 to the auxiliary sheet discharge box 37. Accordingly, the auxiliary sheet discharge box 37 accommodates the B4-size sheet P2.

In Act 173, when the CPU 100 recognizes that the sheet P transported from the upper stock box 23 is not the B4-size sheet P2 (No in Act 173), the operation of the image erasing apparatus 10 proceeds to Act 175. In Act 175, the CPU 100 controls the operation of the classification device 32 to direct the classification branch guide member 22 to the direction of the fourth erasing transport unit 18*d*. The fourth erasing transport unit 18*d* discharges the sheet P to the reject box 13. Accordingly, the reject box 13 accommodates the unfixed-size sheet P. When the operations of Acts 174 and 175 are completed, the operation of the image erasing apparatus 30 returns to Act 172. In Act 172, when there is no sheet P to be transported from the upper stock box 23, in other words, when the transport of all the sheets P in the upper stock box 23 is completed (Yes in Act 172), the classification device 32 completes the classification for each size of the reusable sheets from which the image is erased.

When the classification device 32 completes the classification for each size of the reusable sheets from which the image is erased, the auxiliary sheet discharge box 37 completes the accommodation of all the B4-size sheets P2 that have been accommodated in the upper stock box 23 in a state where all the B4-size sheets P2 that have been accommodated in the upper stock box 23 are stacked on the A3-size sheet P1. Accordingly, the classification device 12 allows the auxiliary sheet discharge box 37 to accommodate all the B4-size sheets P2, thereby completing the classification of the B4-size sheets P2. In addition, the reject box 13 completes the accommodation of all the unfixed-size sheets P that have been accommodated in the upper stock box 23. Accordingly, the classification device 12 allows the reject box 13 accommodates all the unfixed-size sheets P, thereby completing the classification of the unfixed-size sheets P. As described above, the classification of the sheets P of the main size (A4 size) has already been completed. Accordingly, the classification device 12 discharges all the reusable sheets P which are stacked in the sheet feed tray 15 and from which the image is erased, to the sheet discharge box 27, the auxiliary sheet discharge box 37, or the reject box 13. Specifically, the classification device 32 allows the sheet discharge box 27 to accommodate the reusable A4-size sheet P3, allows the auxiliary sheet discharge box 37 to accommodate the reusable sheet P other than A4 size, and discharges the unfixed-size sheet P to the reject box 13, thereby completing the classification of the sheets P.

When the classification performed by the classification device 32 is completed, the operation of the image erasing apparatus 10 is completed. In the sheet discharge box 27, only the A4-size sheet P3 is accommodated. In the auxiliary sheet discharge box 37, the A3-size sheet P1 with the largest size and the B4-size sheet P2 with the second largest size are accommodated in a state where sheets are stacked for each size, in order from the bottom. The user takes out the reusable A4-size sheet P3 of the main size from the sheet discharge box 27, takes out the sheets with the sizes other than the main size from the auxiliary sheet discharge box 37, and may reuse the sheet P. The main size is not limited to A4 size. In addition, the sheet P with the main size is not limited to the sheet with the main size with the highest-frequency size reused by the user. The main size may be arbitrarily determined by the user. The sheet discharge box 27 is the sheet discharge box that accommodates the sheet P with the main size, but may be a storage box only for a reuse sheet P3 with a specific size, for example, A4 size.

According to the second embodiment, the image erasing apparatus 30 classifies the sheets P from which the image is erased by the erasing device 11 for each size by the classification device 32, and accommodates only the A4-size sheet P3 of the main size in the sheet discharge box 27. The image erasing apparatus 30 stacks the sheets P with the plurality of sizes other than the main size for the same size, and accommodates the sheets P in the auxiliary sheet discharge box 37. When the image is erased and the sheet P is reused, it is possible to reduce an effort that the user distributes the sheets P with the necessary size from the erased sheets P. The user easily uses the reused sheets P. Since the image erasing apparatus 30 accommodates the main-size sheet with high frequency of reuse separately from the sheets P with the other size, it is possible to more easily take out the reuse sheet P with the high frequency of use from the sheet discharge box 27, and it is easy to use the reused sheet P.

According to the first and second embodiments described above, it is possible to reduce an effort that the user classifies the recording media for each size after erasing the image. The user easily uses the reused recording media.

The image erasing apparatus of the first and second embodiments described above classifies the recording media for each size using the identification information ID stored in association with the size for each recording medium, but may not use the identification information ID. For example, the image erasing apparatus may be provided with a length detecting unit for a recording medium on a transport path of a transport unit, and may classify the recording media for each size using a detection result of the length detecting unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus erases an image formed on a recording medium, comprising:

an erasing unit configured to erase the image formed on the recording medium;

a reading unit configured to read a size of the recording medium;

a classification device configured to classify each recording medium on which an erasing process of the image has been performed by the erasing unit, for each different size; and a control unit configured to recognize the size of the image erasing-processed recording medium based on data about the size read by the reading unit before a classification process performed by the classification device, and to control the classification device.

2. The image erasing apparatus according to claim 1, wherein the classification device includes first and second stock units that temporarily accommodate the recording medium which has not been classified yet, and a sheet discharge unit that accommodates the classified recording medium.

3. The image erasing apparatus according to claim 2, wherein the control unit repeats that each recording medium which has not been classified yet is alternately accommodated in the first and second stock units, and controls the classification device such that the recording medium with a predetermined size is accommodated for each repetition operation.

4. The image erasing apparatus according to claim 3, wherein the control unit controls the classification device such that all the recording media which have not been classified yet are accommodated in the first stock unit, then the recording medium with a predetermined first size among the recording media accommodated in the first stock unit is accommodated in the sheet discharge unit, and the recording media with sizes other than the predetermined size are accommodated in the second stock unit.

5. The image erasing apparatus according to claim 4, wherein the control unit controls the classification device such that the recording medium with a predetermined second size different from the first size among the recording media accommodated in the second stock unit is accommodated in the sheet discharge unit, and the recording media with sizes other than the second size is accommodated in the first stock unit.

6. The image erasing apparatus according to claim 5, wherein the sheet discharge unit has a sheet discharge box for accommodating the recording medium, and the sheet discharge box accommodates the recording medium with the first size, and subsequently accommodates the recording medium with the second size.

7. The image erasing apparatus according to claim 5, wherein the first size is larger than the second size.

8. The image erasing apparatus according to claim 5, wherein the sheet discharge unit has first and second sheet discharge boxes for accommodating the recording medium, the first sheet discharge box accommodates the recording medium with the first size, and the second sheet discharge box accommodates the recording media with sizes other than the first size.

9. The image erasing apparatus according claim 8, wherein the first size is a size with a high frequency of use.

10. The image erasing apparatus according to claim 5, further comprising a reject box that accommodates the recording medium unrecognizable by the control unit.

* * * * *